United States Patent [19]

Brown et al.

[11] 4,098,401

[45] Jul. 4, 1978

[54] FURNITURE CONTAINER

[75] Inventors: Jimmie L. Brown, Florence, Ala.; Gordon L. Hinton, Savannah, Tenn.; John T. Magazzu, Florence, Ala.

[73] Assignee: Weyerhaeuser Company, Tacoma, Wash.

[21] Appl. No.: 715,364

[22] Filed: Aug. 18, 1976

[51] Int. Cl.[2] ..... B65D 85/64

[52] U.S. Cl. ..... 206/326

[58] Field of Search ..... 206/326, 45.34

[56] References Cited

U.S. PATENT DOCUMENTS

| | | | |
|---|---|---|---|
| 2,068,095 | 1/1937 | Weltzien | 206/326 |
| 2,212,310 | 8/1940 | Wokosin | 206/326 |
| 3,935,943 | 2/1976 | Meyer et al. | 206/45.34 |
| 3,978,982 | 9/1976 | Duncan | 206/326 |

*Primary Examiner*—Herbert F. Ross

[57] ABSTRACT

In containers for packaging articles such as chairs there has been a problem of the container bulging under compression. These containers have a body portion and a neck portion above the body of the container. The present invention uses a two-piece construction to form the container. The first piece is a front section which has a front wall and two generally L-shaped side walls with closure flaps attached to these walls. Each of the side walls has a neck portion adjacent the rear edge of the wall. The second piece is a back section which has a back panel attached to the side walls along the rear edges by securing flaps; a neck top panel covering the top of the neck portion and secured to the side walls by securing flaps; a neck front panel covering the front of the neck portion and secured to the side walls by securing flaps; and a front securing flap secured to the closure flaps. Bottom flaps are attached to the front and side walls and back panel and bottom tabs are attached to the back panel securing flaps.

9 Claims, 16 Drawing Figures

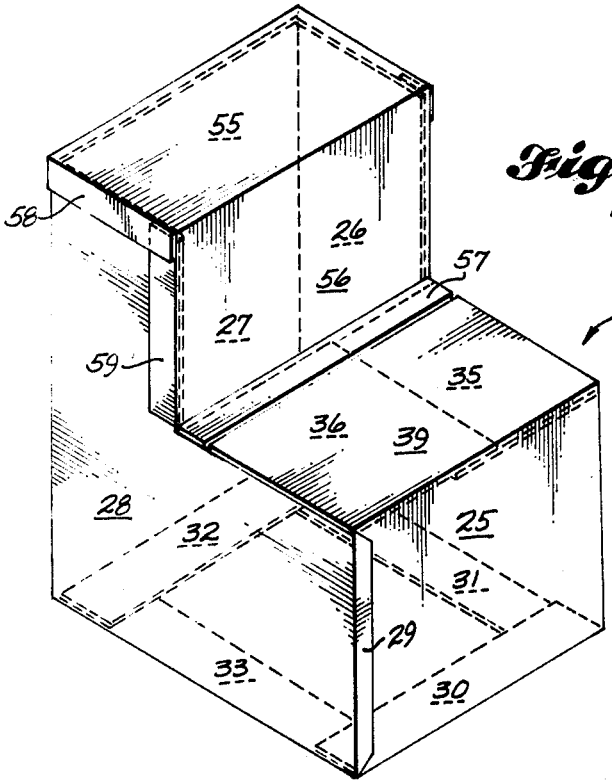
Fig. 4
PRIOR ART
Fig. 5
PRIOR ART
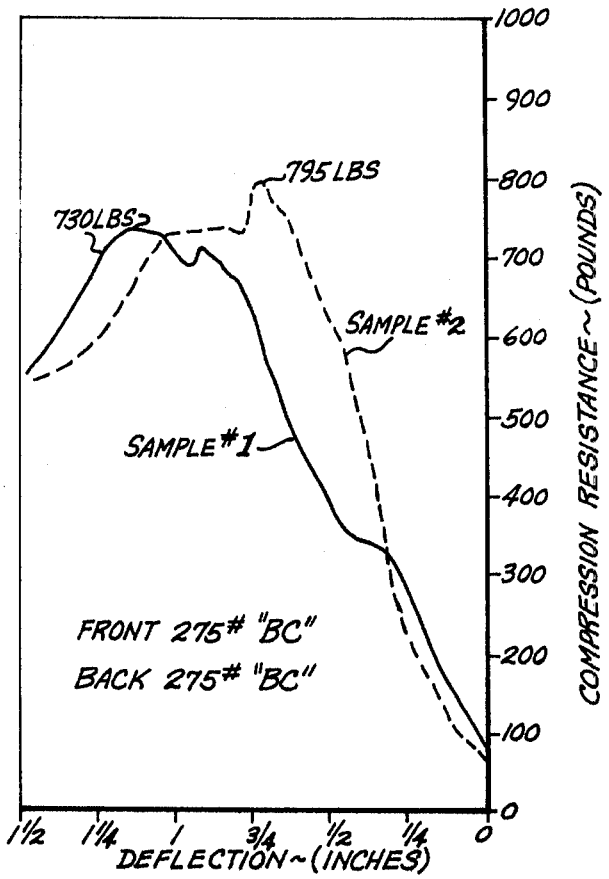

Fig. 6
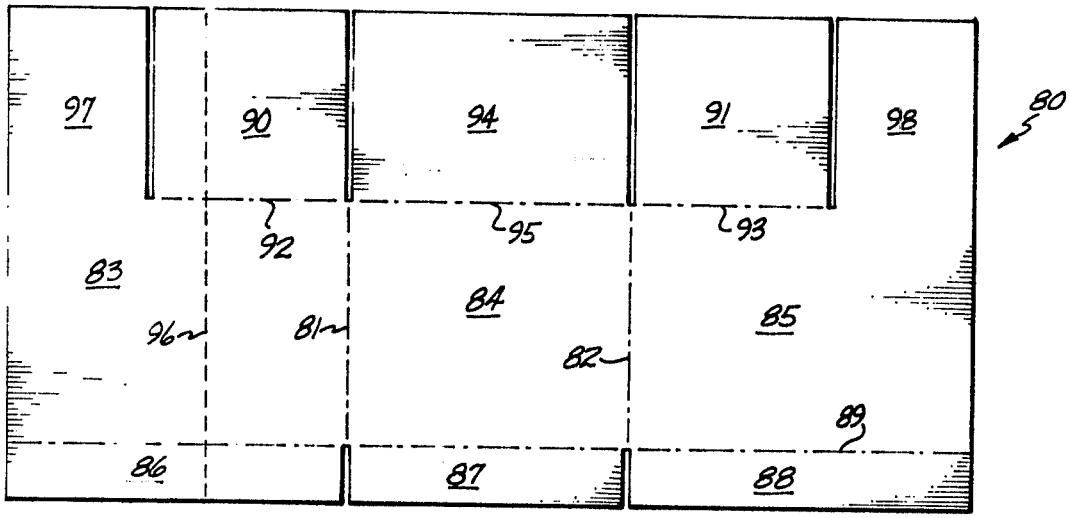
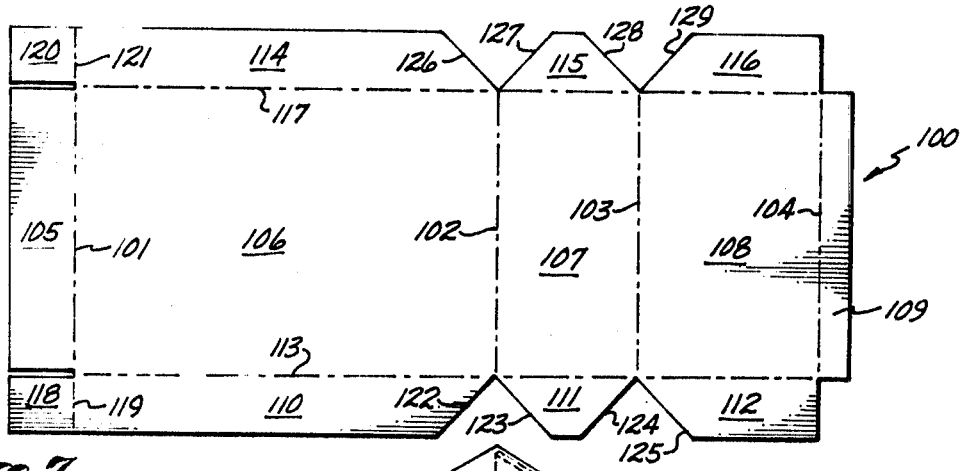
Fig. 7
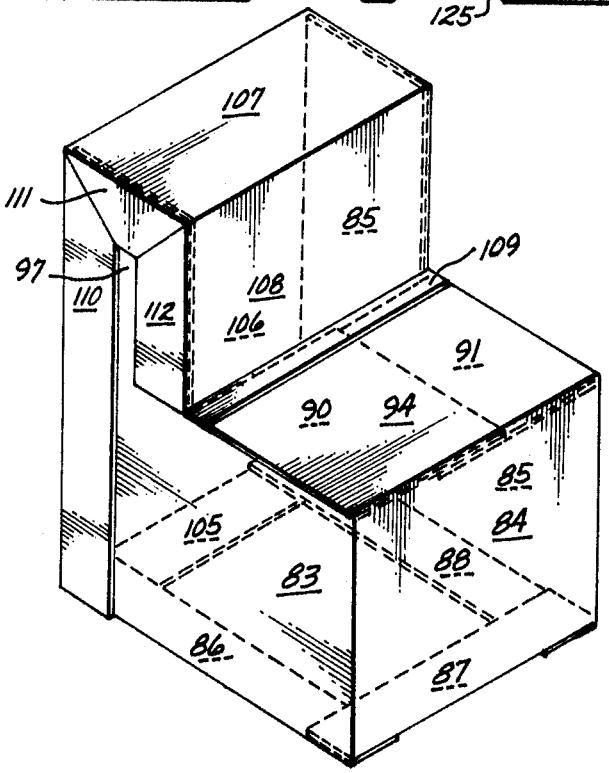
Fig. 11

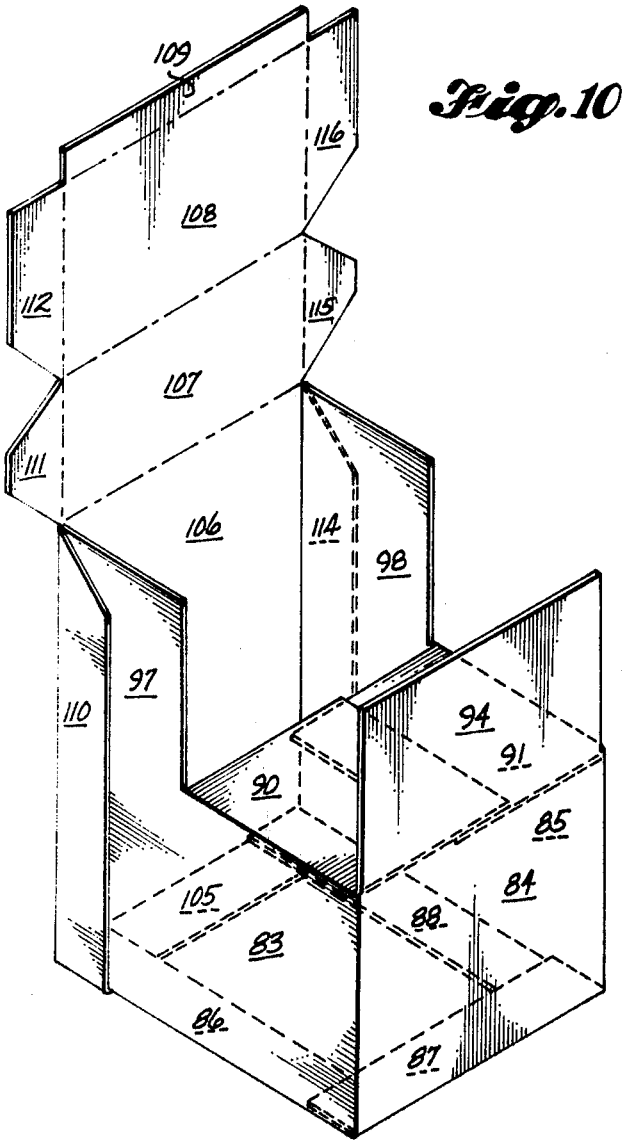
Fig. 10
Fig. 16
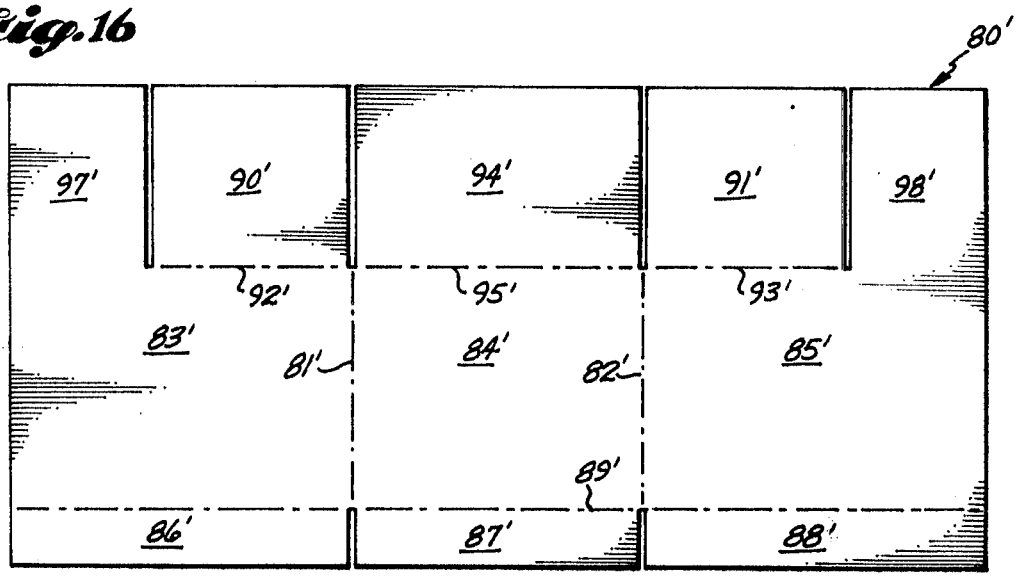

FURNITURE CONTAINER

BACKGROUND OF THE INVENTION

1. Field of the Invention

A corrugated container for packaging articles such as chairs.

2. Prior Art

There are a number of multi-piece L-shaped containers for packaging furniture. One of these in standard use is shown in FIGS. 1–5 of the drawings — FIG. 1 showing the blank of the body panel; FIG. 2 the blank of the top panel; FIG. 3 an exploded view of the furnished container; FIG. 4 the formed container; and FIG. 5 a compression test of this container made with 275 lb. test BC flute.

In this container the body is made from a blank 20 which is divided by score lines 21, 22, 23, and 24 into a front wall 25; an L-shaped side wall 26, a back wall 27, an L-shaped side wall 28 and an attachment flap 29. Bottom flaps are attached to each of the major walls along score line 34; flap 30 being attached to front wall 25; flap 31 being attached to side wall 26; flap 32 being attached to back wall 27; and flap 33 being attached to side wall 28. Closure flaps are also attached to the front and side walls and these form the cover over the body of the container. These are closure flaps 35 and 36 attached to side walls 26 and 28 along score line 37 and 38 respectively and closure flap 39 attached to front wall 25 along score line 40.

The body of the container is shown in FIG. 3. Flap 29 is fastened to front wall 25. The bottom flaps 30 and 32 have been turned inwardly along score line 34 and flaps 31 and 33 turned inwardly underneath them and fastened to them. As will be apparent, score line 34 is not straight but is offset slightly outwardly adjacent flaps 31 and 33. On the upper surface, closure flaps 35 and 36 are bent downwardly over the container body and closure flap 39 is then bent downwardly over the flaps and fastened to them.

The top section is shown in blank form in FIG. 2 and formed in FIG. 3. The blank 50 is divided by score lines 51, 52 and 53 into a back securing flap 54, an upper panel 55, front panel 56 and a lower securing flap 57. Side securing flaps 58 and 59 are attached to panels 55 and 56 respectively along score lines 60 and side securing flaps 61 and 62 are attached to panels 55 and 56 respectively along score line 63. In the formed container, flap 54 attaches to back wall 27, flaps 58 and 59 attach to side wall 28, flaps 61 and 62 attach to side wall 26 and flap 57 attaches to closure flaps 35 and 36. In the container shown closure flap 39 is offset from the neck portion to allow flap 57 to attach to the two lower panels 35 and 36. However, panel 39 may extend to the neck portion and completely overlie the lower panels. In this case flap 57 would attach to panel 39.

The completed container is shown in FIG. 4.

A typical compression test of two sample containers is shown in FIG. 5. In this test the container is set on a surface of the testing machine and pressure applied to surface 55. The curves plot the applied pressure versus the deflection of the container wall in inches. Using samples of 275 lb. test BC flute the maximum compression before collapse of the samples was 730 lbs. and 795 lbs. respectively.

Another approach to this type of container is shown in Bishop, U.S. Pat. No. 2,346,003 and Flynn et al, U.S. Pat. No. 3,181,768. In these, the body is a wrap-around and the L-shaped end panels are separate pieces. Potter, U.S. Pat. No. 1,188,825, shows a four-piece container in which the front panel is taped to the body of the container and the two closure sections are separate units. Cavin, U.S. Pat. No. 2,832,525, shows a two-piece container similar to the one described in the drawings 1–4; and Gibbons, U.S. Pat. No. 2,675,955, shows a two-piece container in which the neck portion is formed as a separate unit.

A container for shipping lavatories is shown in Osborne U.S. Pat. No. 1,131,948. However, the side panels in the osborne container are not L-shaped. The flaps on the back panels are used to obtain an L-shape over a slight portion of the entire container. Consequently, there is no reinforcement of the critical upper section of this package.

SUMMARY OF THE INVENTION

The present invention is also a two-piece corrugated container for packaging furniture, specifically chairs or davenports, and has substantially L-shaped sidewalls and a stairstep configuration. However, the back panel in the present invention is separate and attaches, by side flaps, to both of the L-shaped side walls along the neck portion of the side wall for the entire height of the side wall. The top panel and front panel of the neck portion of the container are attached to the back panel and are also attached to the side walls by side flaps.

This construction allows a container with a much higher resistance to compression for the same flute size.

BRIEF DESCRIPTION OF THE DRAWINGS

FIGS. 1–5 illustrate a prior art container and compression test data therefor.

FIG. 6 shows a top plan view of the blank of the front section of the container.

FIG. 7 is a top plan view of the blank of the back section of the container.

FIGS. 9 and 10 are isometric views of the container in various stages of closure.

FIG. 11 is an isometric view of the closed container.

FIG. 16 is a top plan view of a modified blank of the wall section of the container.

DESCRIPTION OF THE PREFERRED EMBODIMENT

Figure 1:
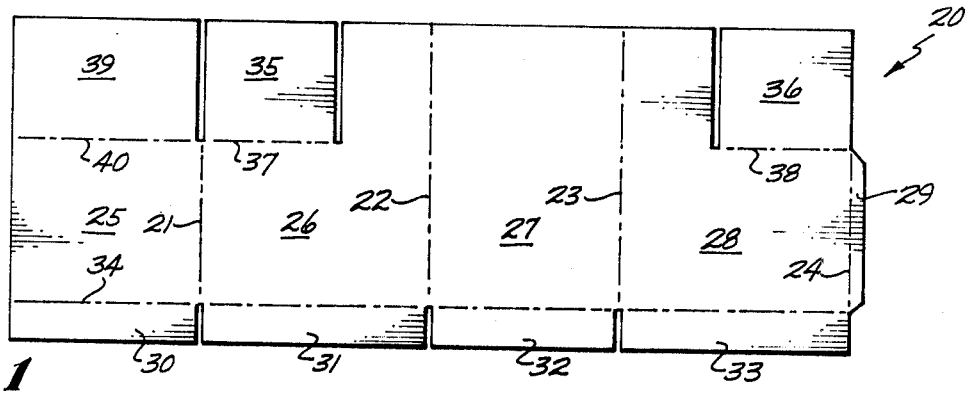
Fig. 1 PRIOR ART
Figure 2:
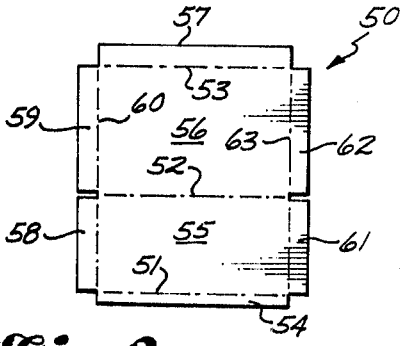
Fig. 2 PRIOR ART
Figure 3:
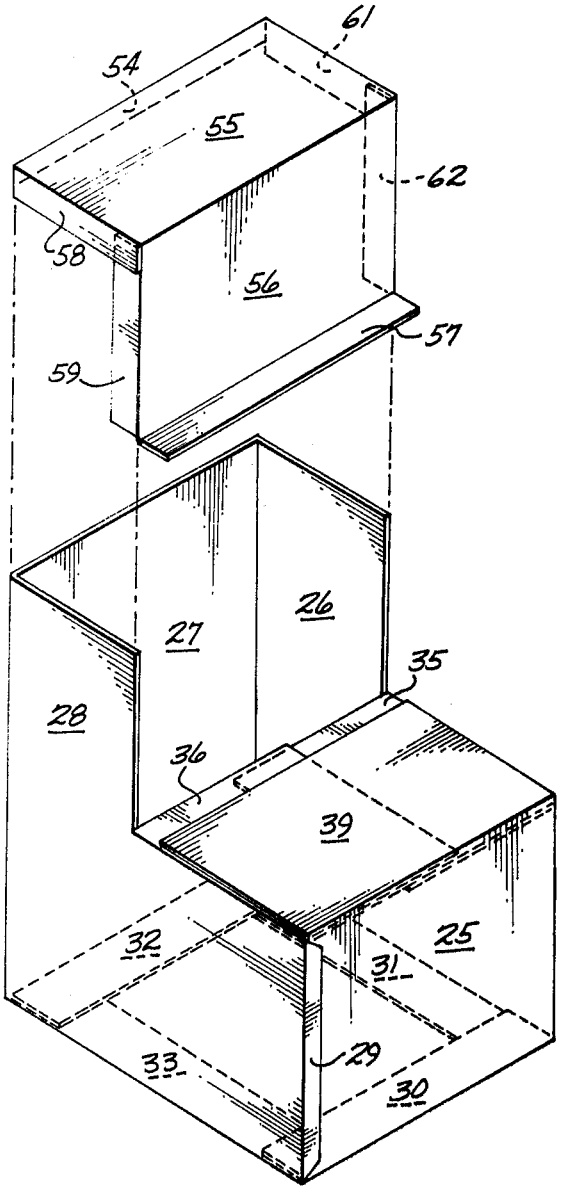
Fig. 3 PRIOR ART
Figure 8:
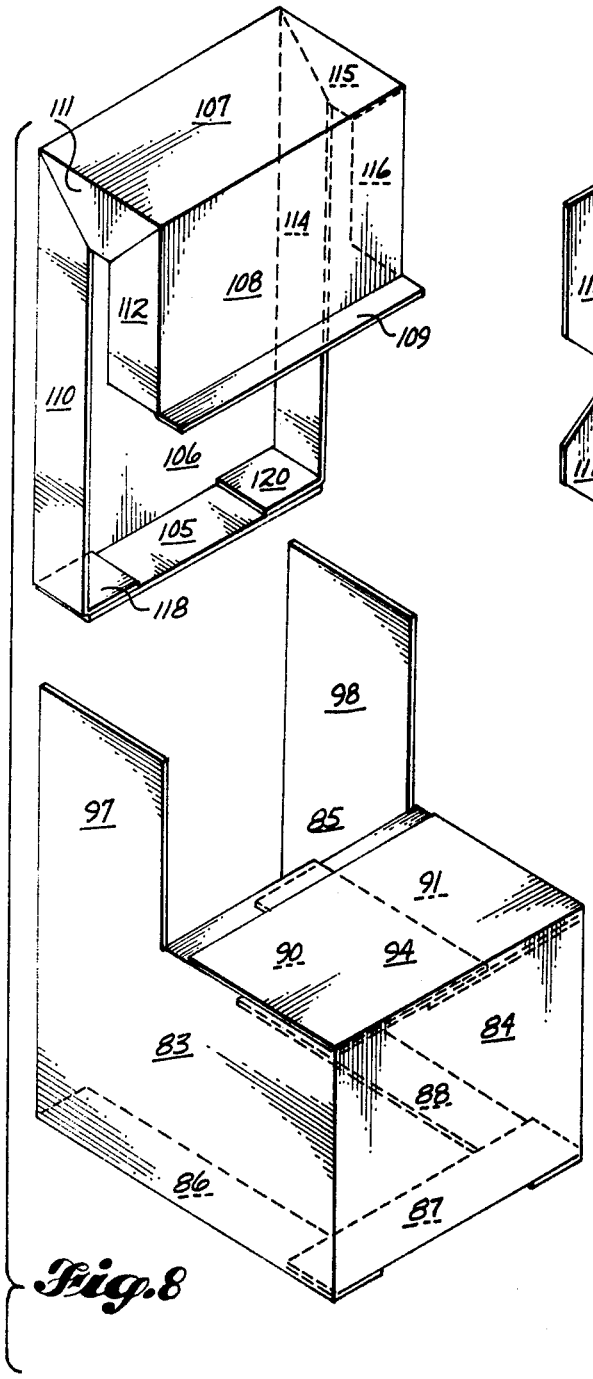
FIG. 8 is an isometric exploded view of the finished container.
Figure 9:
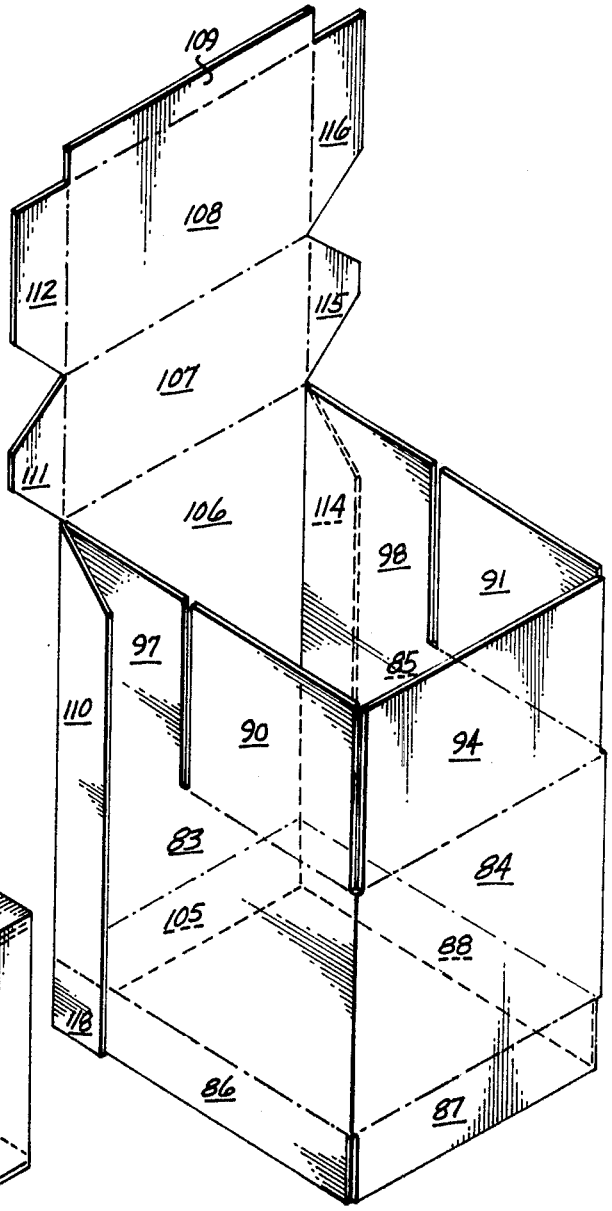

The front section blank 80 is divided by score lines 81 and 82 into a generally L-shaped side wall 83, a front wall 84, and a generally L-shaped side wall 85. Bottom flaps 86, 87 and 88 are attached respectively to side wall 83, front wall 84 and side wall 85 along score line 89. Body closure flaps 90 and 91 are attached respectively to side walls 83 and 85 along score lines 92 and 93. Body closure flap 94 is attached to front wall 84 along score line 95. The blank in FIG. 6 also has a score line 96 which has no structural purpose and in fact creates a weakness in the container. This construction is shown because the compression tests described later were made on containers having this score line. Generally L-shaped side wall 83 has an upwardly extending neck portion 97 adjacent its rear edge, and generally L-shaped side wall 85 has an upwardly extending neck portion 98 adjacent to its rear edge.

The back section blank 100 is divided by score lines 101, 102, 103, and 104 into a bottom flap 105, a back panel 106, a neck top panel 107, a neck front panel 108, and a securing flap 109. Securing flaps 110, 111, and 112 are attached to respective panels 106, 107 and 108 along score line 113 and securing flaps 114, 115 and 116 are also attached to respective panels 106, 107 and 108 along score line 117. The bottom tab 118 may be attached to back panel securing flap 110 along score line 119 and bottom tab 120 may be attached to back panel securing flap 114 along score line 121. The adjacent edges of the securing flaps are beveled so they may substantially abut and allow the securing flaps to lie in the same plane when attached to the side walls; thus, adjacent edges 122 and 123 of flaps 110 and 111; adjacent edges of 124 and 125 of flaps 111 and 112; adjacent edges 126 and 127 of flaps 114 and 115; and adjacent edges 128 and 129 of flaps 115 and 116 are beveled so they will substantially abut in the finished container and the flaps will be in the same plane and not overlie each other.

In forming the container, securing flaps 110 and 114 are attached to side walls 83 and 85 respectively, along the rear edges of the side walls, to provide additional strength to prevent deflection of the container under compression.

In closing the bottom of the container, bottom flaps 86 and 88 are bent inwardly around score line 89 and bottom tabs 118 and 120 are bent inwardly around their respective score lines 119 and 121 and flap 105 bent inwardly around score line 101. Flap 87 may be bent inwardly either above flaps 86 and 88 as shown or below these flaps. The flaps and tabs are secured together.

On the upper surface, closure flaps 90 and 91 are bent inwardly and closure flap 94 bent inwardly over the top of them. Top panel 107 and front panel 108 are bent around the neck portion of the side walls and the side flaps 111, 112, 115 and 116 are bent inwardly against the side walls and secured to the side walls. Front securing flap 109 is attached to either flaps 90 and 91 or flap 94 if it extends to the front edge of the neck portion.

Figure 12:
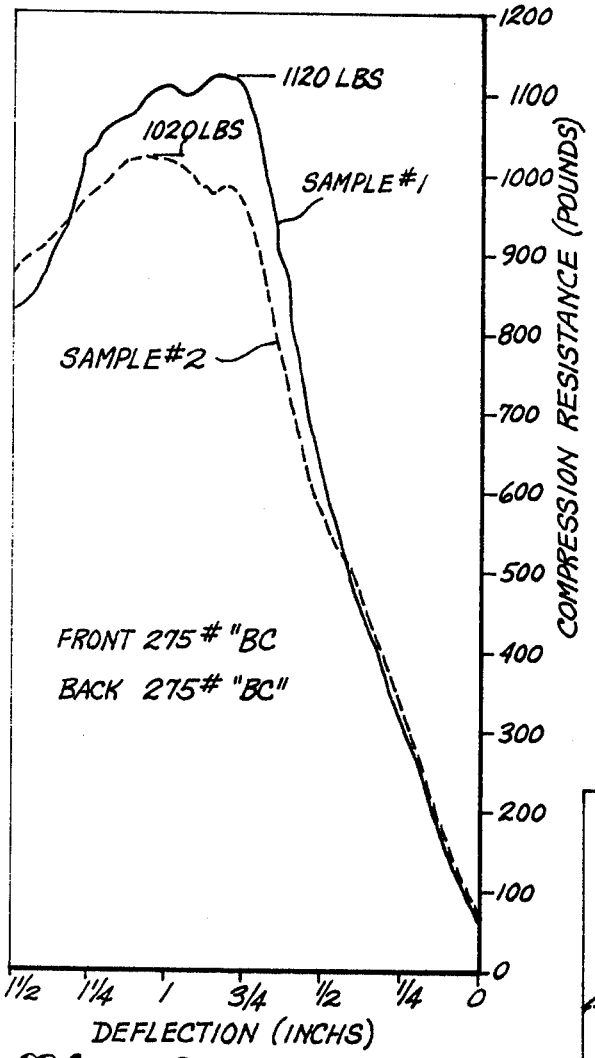
FIGS. 12–15 are graphs of compression tests of the container formed of different flute configurations.

The strength of the container is much greater than the earlier types of containers. This can be seen by comparing FIG. 12 with FIG. 5. Both containers are constructed completely from 275 lb. test BC flute; however, the maximum compression obtained with the present design is 1,020 lbs. and 1,120 lbs. as compared with 730 lbs. and 795 lbs. for the old style container.

Figure 13:
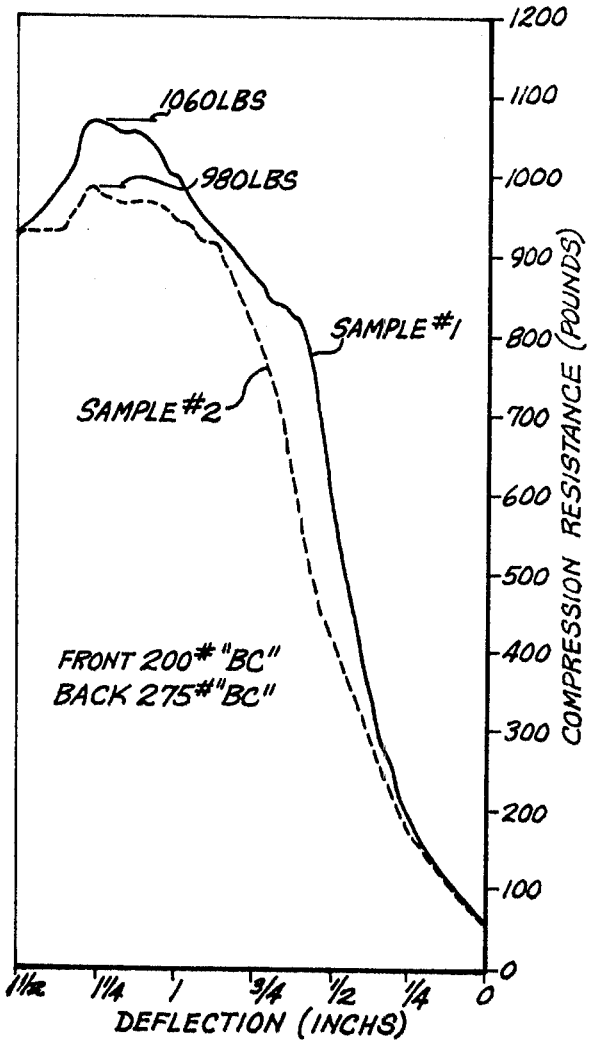
Figure 14:
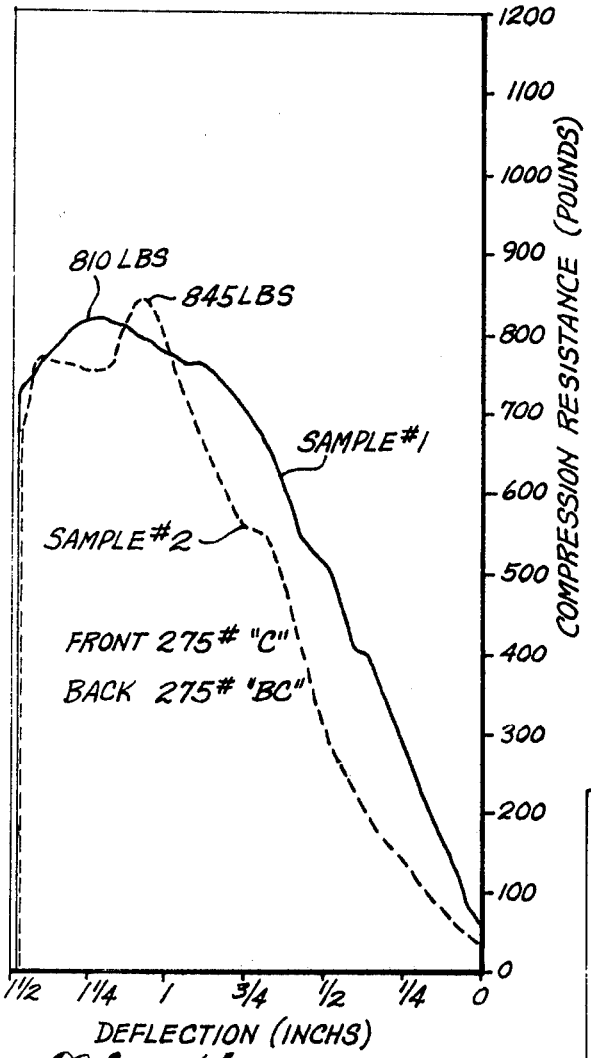
Figure 15:
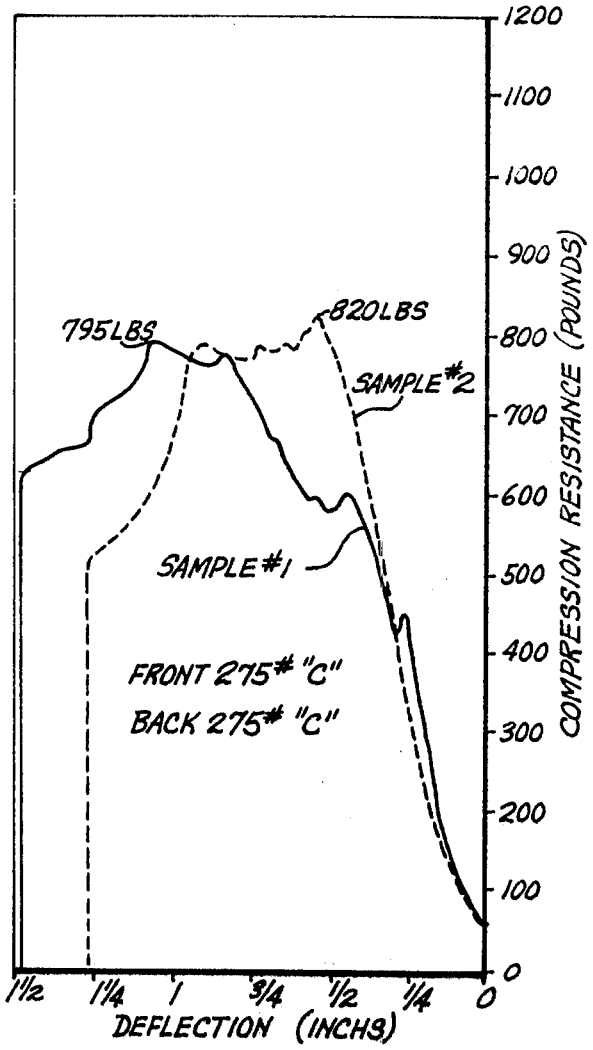

The other three compression tests show that better compression results are achieved with much lighter corrugated board. FIG. 13 shows that if the front section is reduced to a 200 lb. test BC flute, the maximum compression is still 980 lbs. and 1,060 lbs. FIG. 14 shows that if the front section is made of 275 lb. test C flute, the container still withstands 810 lbs. and 1,045 lb. compression. FIG. 15 discloses that if the entire container is reduced to 275 lb. test C flute, the maximum compression is still 795 lbs. and 820 lbs. The present construction achieves much greater compression resistance with the same strength board or equal compression resistance with a much lighter corrugated board.

FIG. 16 shows a modified front section in which score line 96 has been removed. The other reference numbers remain the same.

BC flute is a double walled corrugated board comprising an outer liner, a corrugated layer having B size flutes — an intermediate size flute, an inner liner, a corrugated layer having a C size flute — a small sized flute, and another outer liner. The test pounds of the corrugated board is the bursting strength of the board, the number of pounds per square inch required to burst through the board under specified test conditions.

What is claimed is:

1. A shipping container comprising a lower body and an upper neck formed from a unitary front section comprising a front wall, a pair of generally L-shaped side walls, and closure flaps, said L-shaped side walls attached to said front wall, each of said side walls having a front edge adjacent said front wall, a rear edge spaced from said front wall, and an upwardly extending neck portion adjacent said rear edge, said body closure flap attached to said walls; and a separate unitary back section comprising a back panel, a neck top panel, a neck front panel, and securing flaps on each side of each panel, said back panel interconnecting said rear edges of said side walls, said neck top panel interconnecting the upper edges of said neck portions of said side walls, said neck front panel interconnecting the front edges of said neck portion of said side walls;

said securing flaps connecting said panels to said L-shaped side walls to give added strength to said panels.

2. The container of claim 1 further comprising bottom flaps connected to said front and side walls and said back panel, each of said bottom flaps being secured to adjacent bottom flaps.

3. The container of claim 1 in which said securing flaps are connected to said panels and secure said panels to said side walls.

4. The container of claim 3 further comprising a bottom flap attached to said back panel, and in which said securing flaps comprise back panel securing flaps attached to said side walls adjacent said rear edge, said back panel securing flaps further comprising bottom tabs connected to said back panel flaps, said bottom tabs being attached to said bottom flap.

5. The container of claim 4 in which said securing flaps further comprise neck top and front panel securing flaps attached to said side walls adjacent the top and front edges of said neck portion.

6. The container of claim 5 further comprising a securing flap attached to the lower edge of said neck front panel and attached to said closure flaps.

7. The container of claim 5 in which the adjacent edges of said securing flaps substantially abut.

8. The container of claim 3 in which said securing flaps comprise back panel securing flaps secured to said side walls adjacent said rear edge, neck top panel securing flaps secured to said side walls adjacent the upper edge of said neck portion, and neck front panel securing flaps secured to said side walls adjacent the front edge of the neck portion of said side walls.

9. The container of claim 8 in which the adjacent edges of said securing flaps substantially abut.

* * * * *